United States Patent [19]

Heywood et al.

[11] Patent Number: 4,985,040

[45] Date of Patent: Jan. 15, 1991

[54] TREATMENT OF WOOLLEN TEXTILE MATERIAL

[75] Inventors: Derek W. Heywood, Cheadle Hulme; Stuart B. Howarth, Cannock, both of England

[73] Assignee: BIP Chemicals, Ltd., Manchester, England

[21] Appl. No.: 513,677

[22] Filed: Apr. 24, 1990

[30] Foreign Application Priority Data

May 20, 1989 [GB] United Kingdom ..... 8911668
Nov. 16, 1989 [GB] United Kingdom ..... 8925957

[51] Int. Cl.[5] ..... D06M 11/00; D06M 15/00

[52] U.S. Cl. ..... 8/128.1; 8/127.5; 8/115.7

[58] Field of Search ..... 8/128.1, 127.5, 115.7

[56] References Cited

U.S. PATENT DOCUMENTS 3,285,691 11/1966 Koenig ..... 8/128.1
3,433,575 3/1969 Whitfield et al. ..... 8/128.1

FOREIGN PATENT DOCUMENTS 2185499 7/1987 United Kingdom .

*Primary Examiner*—Paul Lieberman
*Assistant Examiner*—John F. McNally
*Attorney, Agent, or Firm*—Nixon & Vanderhye

[57] ABSTRACT

In a process for the treatment of woollen textile material, which may be in the form of yarn or fabric, to reduce shrinkage and felting and improve resistance to abrasion, by depositing a polyamide-epichlorhydrin resin thereon, the material is given a subsequent treatment with an aqueous polyurethane dispersion. The polyurethane thus disposed adds to the improvement in properties brought about by the polyamide-epichlorhydrin resin. The woollen textile material to the treated, especially when in the form of yarn, may comprise wool admixed with other (particularly synthetic) fibre, such as fibres of viscose, polyesters and especially polyamides, such as nylon.

6 Claims, No Drawings

TREATMENT OF WOOLLEN TEXTILE MATERIAL

This invention relates to the treatment of woollen textile material, which may be in the form of yarn or in other form, such as wool tops, woollen piece goods or woollen garments, and is concerned with treatment to reduce shrinkage and felting and improve resistance to abrasion.

For the purposes just referred to is is common to treat woollen textile material with an aqueous solution of the resin reaction product of epichlorhydrin with a polyamide whose repeating unit contains basic —NH—or —$NH_2$ groups, as distinct from the non-basic —NH— group of the amide linkage —NH.CO—. Such a resin is for example that obtained by the reaction of epichlorhydrin with the condensation product of diethylene triamine ($H_2NCH_2CH_2NHCH_2CH_2NH_2$) and adipic acid ($HO_2C(CH_2)_4CO_2H$).

We have now found that the reduction of shrinkage and felting, and the resistance to abrasion, of woollen textile material can be even further improved by depositing a polyurethane from aqueous dispersion onto woollen textile material already treated with a polyamide-epichlorhydrin resin. The deposition very probably occurs because the polyurethane is weakly anionic, whereas the previously deposited epichlorhyrdin resin is cationic.

The polyurethane is preferably a polyester-based aliphatic polyurethane containing salt-form acid groups, particularly carboxylate groups, eg—$CO_2Na$ or —$CO_2NH(C_2H_5)_3$. Aqueous dispersions of such polyurethanes are commercially available for the finishing of leather requiring outstanding resistance to abrasion.

Woollen textile material to be treated, especially when in the form of yarn, may comprise wool admixed with other (particularly synthetic) fibre, such as fibres of viscose, polyesters, and especially polyamides, such as nylon. Fabrics made up from such treated yarn, e.g. carpets, have very good resistance to abrasion.

The invention is further illustrated by the following Examples.

EXAMPLE 1

Hanks of woollen yarn freshly withdrawn from the dyebath were immersed in an aqueous solution (2% solids by weight) obtained by diluting with water the cationic polyamide-epichlorhydrin resin solution sold under the name BEETLE BT 747, pH about 3 and solids content 12.5% by weight. (BEETLE is registered trade mark).

The resin-exhausted liquid was drained from the treatment vessel, which was then filled with aqueous polyurethane dispersion to cover the woollen hanks, onto which about 2% of their weight of polyamide-epichlorhydrin resin had become deposited as a result of the previous treatment. The polyurethane dispersion employed was one containing 2% by weight of the product, pH about 8, commercially available under the name BEETLE BT 9010, containing 35% by weight of a polyester-based aliphatic polyurethane containing carboxylate groups in salt form at intervals along the polymer chain.

After standing for 2 minutes, the exhausted polyurethane dispersion was run off and the hanks were washed with water. Finally, the treated hanks were drained, and dried in air at about 130° C.

The above procedure can equally well be applied to hanks during (as distinct from after) the dyeing operation.

In the continuous treatment of yarn, the yarn is drawn first through a bath of the polyamide-epichlorhydrin resin, then through a bath of the polyurethane dispersion, and finally (after a water-rinse) through a drying unit.

EXAMPLE 2

Hanks of carpet yarn, composed of wool (80% by weight) and nylon (20% by weight), freshly withdrawn from the dyebath were immersed in an aqueous solution (2% solids by weight of cationic polyamide-epichlorhydrin resin solution as in the previous Example.

The resin-exhausted liquid was drained from the treatment vessel, which was then filled with aqueous polyurethane dispersion to cover the wool/nylon hanks, onto which about 2% of their weight of polyamide-epichlorhydrin resin had become deposited as a result of the previous treatment. The polyurethane dispersion employed was as in Example 1. After standing for 2 minutes, the exhausted polyurethane dispersion was run off and the hanks were washed with water. The treated hanks were drained, dried in air at 130° C. and then woven to form a carpet by entirely conventional means (a loop pile weaving machine). The carpet was conditioned for 24 hours in a standard atmosphere (65%±2% relative humidity at 20°±2° C.), and then tested for abrasion-resistance in that atmosphere.

Results were:

| | Rubs to end point |
|---|---|
| Carpet woven from untreated 80:20 wool/nylon yarn | 59,000 |
| Carpet woven from the yarn treated as described | 70,000 |

We claim:

1. In a process for the treatment of woollen textile material to reduce shrinkage and felting and improve resistance to abrasion, by depositing a polyamide-epichlorhydrin resin thereon, the improvement which comprises subsequently depositing a polyurethane onto the material from an aqueous polyurethane dispersion.

2. A process according to claim 1, in which the polyurethane is a polyester-based aliphatic polyurethane containing salt-form acid groups.

3. A process according to claim 2, in which said groups are carboxylate groups.

4. A process according to claim 1, in which the woollen textile material is in the form of yarn.

5. A process according to claim 4, in which the yarn is of wool admixed with synthetic fibre.

6. A process according to claim 5, in which the synthetic fibre is a polyamide.

* * * * *